US006847160B2

(12) United States Patent
Kim

(10) Patent No.: US 6,847,160 B2
(45) Date of Patent: Jan. 25, 2005

(54) FUNNEL STRUCTURE OF CATHODE-RAY TUBE

(75) Inventor: Do Hoon Kim, Daegu-si (KR)

(73) Assignee: LG. Philips Displays Korea Co., Ltd., Gyeongsangbuk-do (KR)

( * ) Notice: Subject to any disclaimer, the term of this patent is extended or adjusted under 35 U.S.C. 154(b) by 0 days.

(21) Appl. No.: 10/157,818

(22) Filed: May 31, 2002

(65) Prior Publication Data

US 2003/0052590 A1 Mar. 20, 2003

(30) Foreign Application Priority Data

Sep. 14, 2001 (KR) ..... 2001-56928

(51) Int. Cl.[7] ..... H01J 31/00
(52) U.S. Cl. ..... 313/477 R
(58) Field of Search ..... 313/477 R, 440, 313/461; 220/2.1 R, 2.1 A

(56) References Cited

U.S. PATENT DOCUMENTS 5,155,411 A * 10/1992 Swank et al. ..... 313/477 R
5,258,688 A * 11/1993 Fondrk ..... 313/477 R
5,751,103 A * 5/1998 Opresko et al. ..... 313/477 R
5,962,964 A * 10/1999 Sano et al. ..... 313/440
6,307,313 B1 * 10/2001 Fukuda ..... 313/421
6,323,591 B1 * 11/2001 Oosterhout et al. ..... 313/477 R
6,359,379 B1 * 3/2002 Lee et al. ..... 313/477 R
6,380,668 B1 * 4/2002 Kim et al. ..... 313/477 R
6,384,525 B1 * 5/2002 Sano et al. ..... 313/440
6,577,055 B1 * 6/2003 Sugawara et al. ..... 313/477 R
6,680,566 B2 * 1/2004 Hergott et al. ..... 313/477 R

* cited by examiner

*Primary Examiner*—Nimeshkumar D. Patel
*Assistant Examiner*—Peter Macchiarolo
(74) *Attorney, Agent, or Firm*—Birch, Stewart, Kolasch & Birch, LLP

(57) ABSTRACT

A color cathode-ray tube has an optimum funnel structure so that it has a slim tube structure while reducing stress caused by its internal vacuum pressure. The color cathode-ray tube satisfies a relation of $0.12 \times L' < S < 0.27 \times L'$ where "L" represents a length from a seal line, where a panel and a funnel are sealably coupled together, to a yoke line of the funnel in an axial direction of the tube, "L'" represents ½ of the length of the seal line, "A" represents ½ of a seal stress adjustment line formed by connecting points spaced apart from the seal line by a distance of "L×0.67" toward the yoke portion, and "S" represents a difference between "L'" and "A". The cathode-ray tube of the present invention has an optimum funnel structure capable of providing an effect of reducing the high stress conventionally generated around the seal line and yoke line by 25% and 53%, respectively. In addition, it is possible to secure desired resistance to impact, and to achieve an improvement in process yield in accordance with the reduction of the stress generated at the funnel in a vacuum state.

4 Claims, 7 Drawing Sheets

FUNNEL STRUCTURE OF CATHODE-RAY TUBE

BACKGROUND OF THE INVENTION

1. Field of the Invention

The present invention relates to a color cathode-ray tube, and more particularly to a color cathode-ray tube which has an optimum funnel structure so that it has a slim tube structure while reducing stress caused by its internal vacuum pressure.

2. Description of the Related Art

FIG. 1*a* is a partially-broken side view illustrating the structure of a general color cathode-ray tube.

Such a color cathode-ray tube is used as an essential element for displaying images in an image display unit such as a television receiver or a computer monitor. Referring to FIG. 1*a*, the color cathode-ray tube includes a panel 1 constituting a front part of the cathode-ray tube, and a funnel 2 extending rearward from the panel 1.

The color cathode-ray tube also includes a fluorescent film (screen) 4 coated over the inner surfaces of the panel 1 and funnel 2 to serve as a desired luminescent element, an electron gun fitted in a neck portion 13 of the funnel 2 and adapted to emit electron beams 6 for causing the fluorescent surface 4 to emit light, a shadow mask 3 for performing color selection for causing desired portions of the fluorescent film 4 to emit light, a frame including a main frame 7 adapted to apply tension to the shadow mask 3, and a sub frame 8 adapted to support the main frame, springs 9 mounted to respective side portions of the main frame 7 to allow the frame to be coupled to the panel 1, an inner shield 10 welded to the sub frame 8 and adapted to shield an external earth magnetic field, and a reinforcing band 12 fitted around the panel 1 and adapted to protect the panel 1 from external impact.

A deflection yoke 5 and magnets 11 of 2, 4, and 6 poles are arranged around the neck portion 13 of the funnel 2. The deflection yoke 5 serves to deflect electron beams 6 emitted from the electron gun (not shown) in upward, downward, leftward, and rightward directions. The magnets 11 serve to correct the travel paths of the emitted electron beams 6 so as to cause those electron beams 6 to accurately strike onto desired portions of the fluorescent film 4, thereby preventing a degradation in color purity.

The manufacturing process of the general color cathode-ray tube having the above described configuration mainly involves a pre-process and a post-process. The pre-process is a process for coating a fluorescent film over the inner surface of the panel. The post-process involves various processes.

That is, the panel coated with the fluorescent film and mounted with a mask assembly therein, and the funnel coated with frit at a seal surface thereof are subjected to a sealing process in a furnace maintained at high temperature so that they are coupled to each other. The electron gun is fitted in the neck portion of the funnel in an encapsulating process. A vacuum is formed in the interior of the cathode-ray tube in accordance with an air exhaust process. The cathode-ray tube is then sealed.

When the cathode-ray tube is in a vacuum state, its panel and funnel are subjected to high tensile stress and high compressive stress.

To this end, a reinforcing process is carried out to attach the reinforcing band to the panel for dispersion of high stress exerted on the front surface of the panel. Thus, the manufacture of the cathode-ray tube is completed.

Meanwhile, although digitalization of cathode-ray tubes is important, slimness of those cathode-ray tubes is also important in association with the securing of a redundant space.

Where cathode-ray tubes have a slim structure, their glass portions are subjected to vacuum stress increased correspondingly to a reduction in volume caused by the slimness, because the vacuum pressure is constant in spite of the volume reduction.

Furthermore, in such a slim cathode-ray tube, formation of high stress mainly occurs at the funnel portion having a relatively small thickness, rather than at the panel. In particular, the seal line portion of the cathode-ray tube may be easily damaged in a thermal process because high tensile stress is present at that seal line portion.

Methods for reducing the overall length of a cathode-ray tube have also been proposed. Such methods include a method for reducing the overall length of the panel, and a method for reducing the overall length of the funnel body. The method for reducing the overall length of the funnel body may be more preferable.

Where the overall length of the panel is reduced under the condition in which the funnel has a relatively thin structure, an undesirable result may occur in association with formation of high tensile stress at the seal line portion due to the vacuum pressure generated in the air exhaust process. Furthermore, it may be impossible to provide a sufficient space for the clamping of the band. As a result, a degradation in the effectiveness of the band may occur due to an insufficient clamping tension of the band.

FIG. 3 shows distribution of stress applied to the panel and funnel glass under the condition in which a vacuum is formed in the interior of the cathode-ray tube in accordance with an air exhaust process. In FIG. 3, the phantom line represents compressive stress, whereas the solid line represents tensile stress.

Cracks may be formed when glass is subjected to external impact. In this case, tensile stress applied to the surface of the glass accelerates propagation of cracks. Where the applied tensile stress is excessively high, the glass may be broken. On the other hand, compressive stress serves to prevent propagation of cracks.

Referring to FIG. 3, the central portion of the panel, the central portion of a skirt extending from the peripheral edge of the panel, and the central portion of the funnel are relatively resistant to impact because they are subjected to compressive stress, whereas the corner portions and seal line portion of the panel are sensitive to impact because they are subjected to tensile stress.

For reducing or coping with high tensile stress generated at the glass, various methods have been proposed in association with the panel. For example, a method using a reinforcing band, and a method using a reinforced glass having an increased stiffness in accordance with a thermal treatment of the glass, and a method using a film to be attached to the surface of the panel have been proposed. However, the reinforcing band exhibits an insufficient effect where it is applied to the funnel. Furthermore, there has been no case in which reinforced glass is used for the funnel.

Accordingly, a technique to secure desired resistance to impact while reducing stress is required for the funnel.

SUMMARY OF THE INVENTION

Therefore, an object of the invention is to provide a color cathode-ray tube which has an optimum funnel structure so that it has a slim tube structure while reducing stress caused by its internal vacuum pressure.

In accordance with the present invention, this object is accomplished by providing a color cathode-ray tube comprising: a panel provided at an inner surface thereof with a fluorescent screen; a funnel sealably coupled to the panel while being maintained in a vacuum state; an electron gun fitted in a neck portion of the funnel, and adapted to generate electron beams for causing the fluorescent screen to emit light; a deflection yoke arranged at a yoke portion of the funnel, and adapted to deflect the electron beams; a shadow mask spaced apart from the fluorescent screen by a desired distance, and adapted to perform a color selecting function; and a frame adapted to supply the shadow mask while applying tension to the shadow mask; wherein a relation of $0.12\times L'<S<0.27\times L'$ is satisfied where "L" represents a length from a seal line, where the panel and the funnel are sealably coupled together, to a yoke line of the funnel in an axial direction of the tube, "L'" represents ½ of the length of the seal line, "A" represents ½ of a seal stress adjustment line formed by connecting points spaced apart from the seal line by a distance of "L×0.67" toward the yoke portion, and "S" represents a difference between "L'" and "A".

Preferably, the angle formed between a line connecting a diagonal edge of an effective surface (effective viewing area of the screen) and an intersection point between an axis of the tube (tube axis) and a reference line in the yoke portion, and the axis of the tube (tube axis) is 50 to 70°.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, preferred embodiments of the present invention will be described in detail with reference to the annexed drawings.

As described above, conventional funnels, in particular, funnels of conventional cathode-ray tubes having a reduced overall length, exhibit high tensile stress at a seal line where the panel and funnel are sealably coupled together, and at a funnel yoke line where the funnel body and yoke (deflection yoke) are coupled together. Here, the seal line is a region where the panel and funnel are sealably coupled together, whereas the funnel yoke line is a region where the funnel body and yoke (deflection yoke) are coupled together. In particular, the funnel yoke line is a line where the deflection yoke adapted to deflect electron beams is positioned at a position nearest to the panel.

Figure 1B:
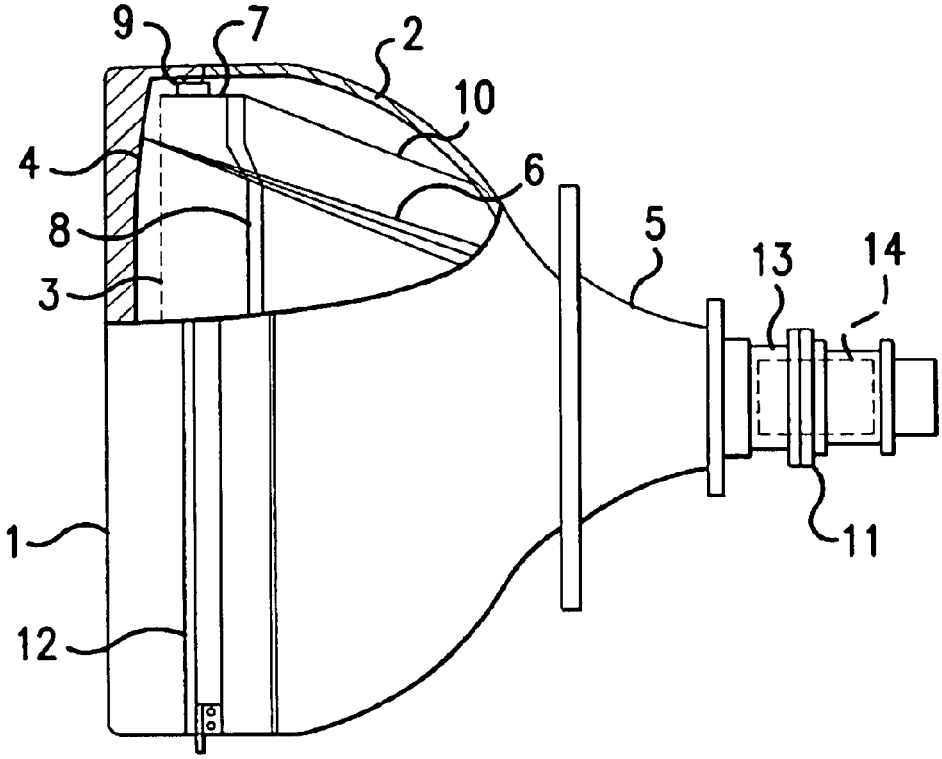
FIG. 1*b* is a partially-broken side view of an example of a cathode ray tube according to the present invention.
Figure 3:
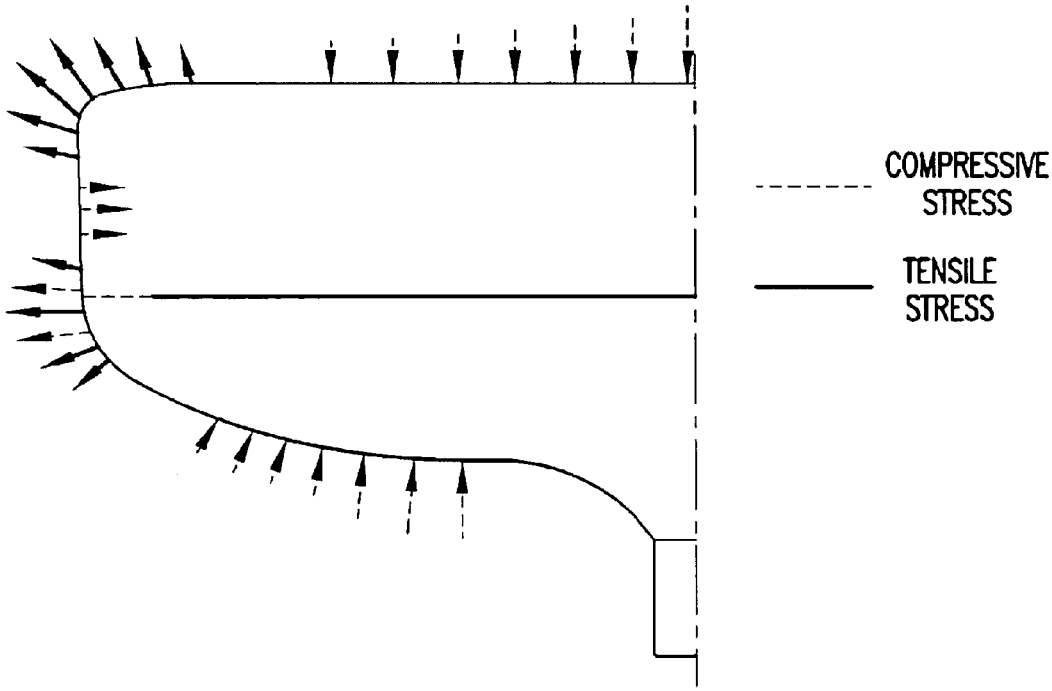
FIG. 3 is a schematic view illustrating the distribution of stress applied to the panel and funnel glass in a vacuum state.

FIG. 1*b* illustrates an example of a CRT on which the present invention may be implemented. Like numerals are used to designate like parts. Reference numeral 14 designates an electron gun.

Figure 4A:
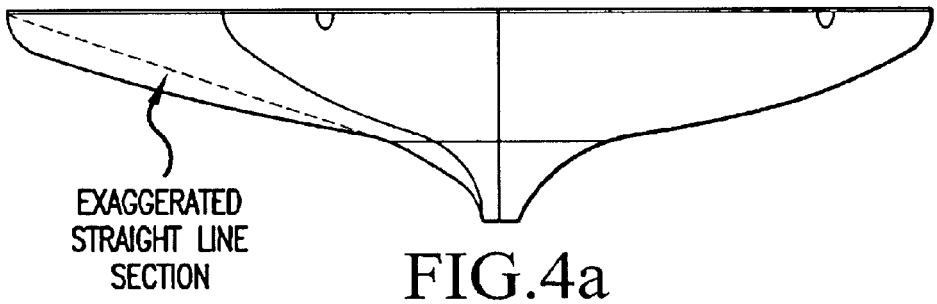
FIGS. 4*a* and 4*b* are views respectively illustrating two virtual funnel shapes each having a funnel body with an extreme outer curvature.
Figure 4B:
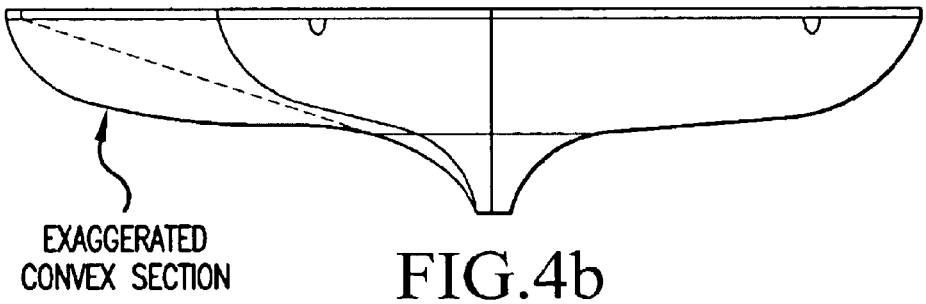

FIGS. 4*a* and 4*b* are views respectively illustrating two virtual funnel shapes each having a funnel body with an extreme outer curvature.

FIG. 4*a* shows a funnel shape in which the vacuum stress generated in a vacuum state of the tube is distributed to be high at the seal line region while being low at the yoke line region, whereas FIG. 4*b* shows a funnel shape in which vacuum stress is distributed to be low at the seal line region while being high at the yoke line region.

Exaggeratingly, the funnel shape of FIG. 4*a*, that is, the first comparative funnel shape, may be considered to have a curvature defined by a section connected between the end of the seal line and the end of the yoke line by a straight line, whereas the funnel shape of FIG. 4*b*, that is, the second comparative funnel shape, may be considered to have a curvature defined by a section connected between the end of the seal line and the end of the yoke line by a convex curve line.

Figure 5:
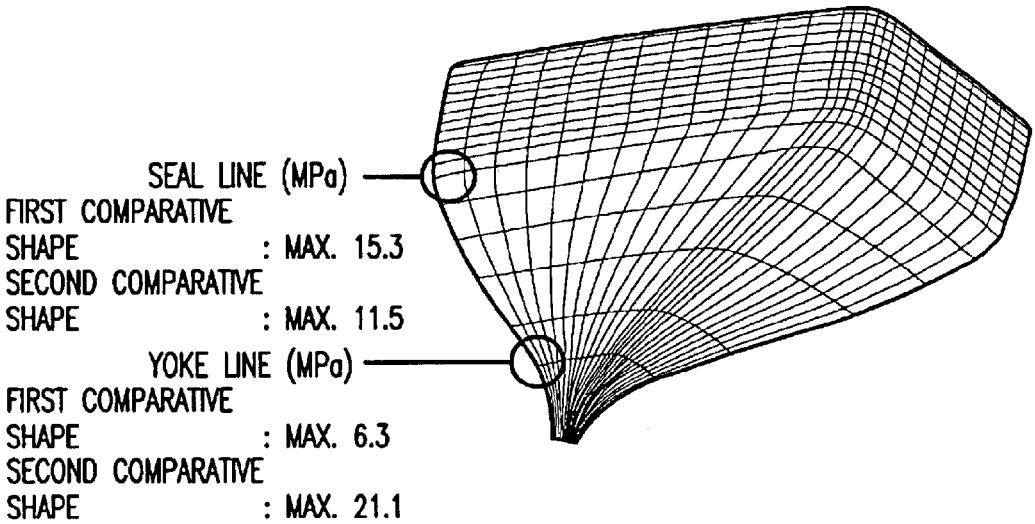
FIG. 5 is a diagram illustrating simulated stress distributions at essential regions in the funnel shapes of FIGS. 4*a* and 4*b;*

FIG. 5 shows simulated stress distributions at essential regions in the funnel shapes of FIGS. 4*a* and 4*b*.

Typically, it is necessary to carefully take into consideration the tensile stress caused by vacuum upon designing the cathode-ray tube glass. Conventionally, the critical stress of the glass is designed to be 12 MPa or less.

However, stress of 15.3 MPa exceeding the critical stress of the glass is applied to the seal line region in the case of the first comparative funnel shape, whereas stress of 21.1 MPa exceeding the critical stress of the glass is applied to the yoke line region in the case of the second comparative funnel shape. For this reason, it is impossible to achieve an effective stress reduction using the glass with a critical stress of 12 MPa. Furthermore, the generation of stress exceeding the critical stress of the glass causes diverse difficulties in the manufacturing process.

Therefore, where the funnel shape of FIG. 4*a* or 4*b* is applied to the design of cathode-ray tubes having a slim structure, it is impossible to achieve an effective stress reduction.

Figure 6:
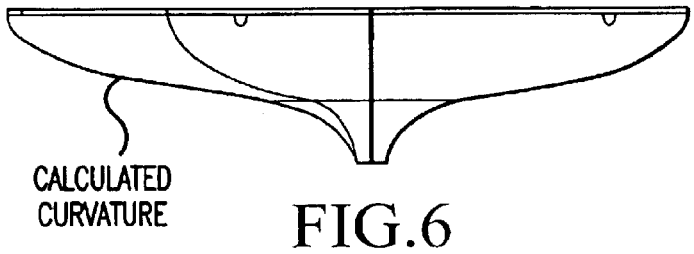
FIG. 6 is a view illustrating a funnel shape according to the present invention.

FIG. 6 illustrates a funnel shape according to the present invention.

Referring to FIG. 6, it can be seen that the curvature of the funnel body according to the present invention (calculated curvature) is formed to be between the curvatures of the first and second comparative funnel shapes.

The funnel shape of the present invention will now be described in more detail.

Figure 7:
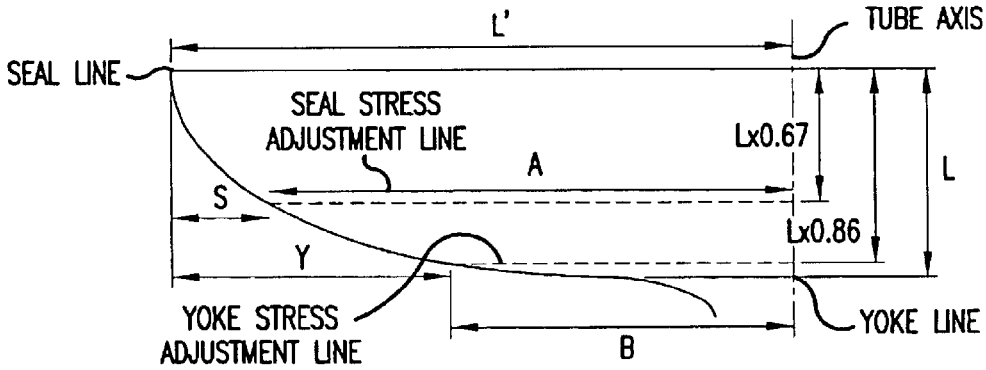
FIG. 7 is a schematic view defining elements according to the present invention.

FIG. 7 shows elements for concretely illustrating the funnel shape of the present invention.

In FIG. 7, "L" represents the length extending from the seal line to the yoke line in the axial direction of the tube, whereas "L'" represents ½ of the length of the seal line.

In FIG. 7, the "seal stress adjustment line" represents the line formed by connecting points spaced apart from the seal line by a distance of "L×0.67" toward the yoke, whereas the "yoke stress adjustment line" represents the line formed by connecting points spaced apart from the seal line by a distance of "L×0.86" toward the yoke. In FIG. 7, "A" represents ½ of the seal stress adjustment line, and "B" represents ½ of the yoke stress adjustment line.

It is possible to reduce the high stress around the seal line, and to control the stress generating position by optimizing the design value of "S" defined by the seal stress adjustment line. Results obtained by measuring high stress applied to the seal line while varying the length of the seal stress adjustment line are described in the following Table 1.

TABLE 1

| S | Stress (MPa) |
|---|---|
| 0.10 | 10.1 |
| 0.15 | 10.3 |
| 0.20 | 10.4 |
| 0.25 | 11.5 |
| 0.30 | 11.9 |
| 0.35 | 12.5 |
| 0.40 | 15.5 |

In Table 1, "S" represents the difference between "L'" and "A".

Figure 8:
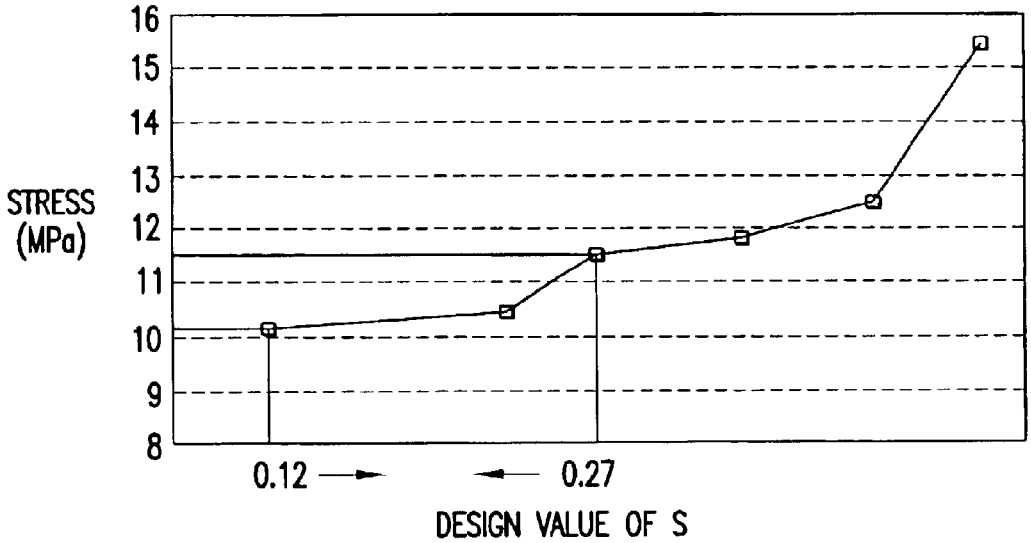
FIG. 8 is a graph depicting a variation in stress applied to a seal line depending on a variation in the value of "S"

FIG. 8 shows a graph depicting the results described in Table 1.

It is possible to reduce the high stress around the yoke line by optimizing the design value of "Y" defined by the yoke stress adjustment line. Results obtained by measuring high stress applied to the yoke line while varying the length of the yoke stress adjustment line are described in the following Table 2.

TABLE 2

| Y | Stress (MPa) |
|---|---|
| 0.30 | 21.1 |
| 0.35 | 15.3 |
| 0.40 | 13.2 |
| 0.45 | 9.0 |
| 0.50 | 7.4 |
| 0.55 | 6.9 |
| 0.60 | 6.1 |

In Table 2, "Y" represents the difference between "L'" and "B".

Figure 9:
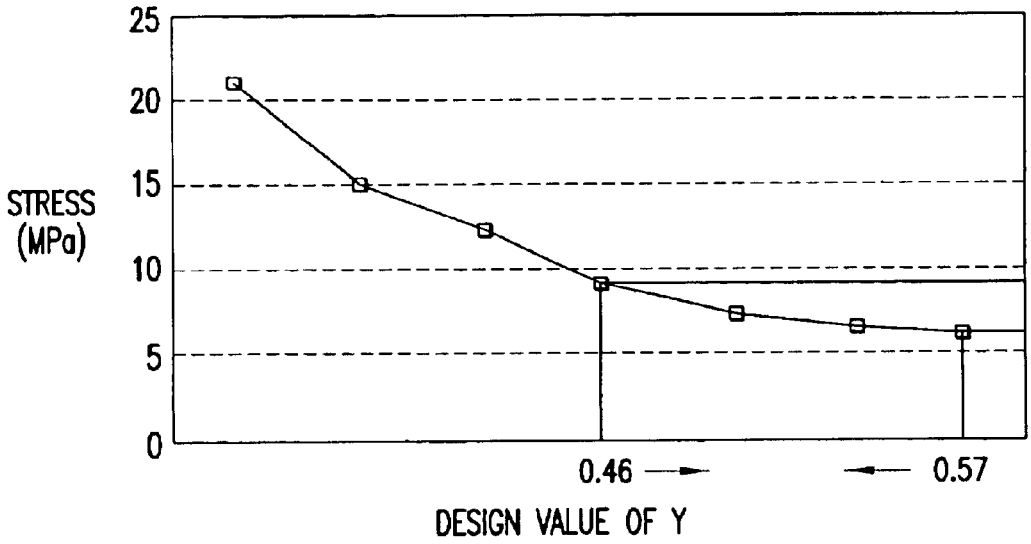
FIG. 9 is a graph depicting a variation in stress applied to a yoke line depending on a variation in the value of "Y"

FIG. 9 shows a graph depicting the results described in Table 2.

In particular, in accordance with the present invention, the maximum allowable stress for the seal line region is set to be 11.5 MPa or less, and the maximum allowable stress for the yoke line region is set to be 10 MPa or less, in order to reduce the high stress applied to the seal line and yoke line.

Accordingly, an optimum design is made by maintaining the following correlations:

$$0.12\times L'<S<0.27\times L'$$

$$0.46\times L'<Y<0.57\times L'$$

In the correlations, "S" is positioned on the seal stress adjustment line while corresponding to the difference between "L'" and "A", whereas "Y" is positioned on the yoke stress adjustment line while corresponding to the difference between "L'" and "B".

That is, it is possible to reduce the high stress applied to the seal line and yoke line under the condition in which "S" is within a range of 12 to 17% of the seal line length, and "Y" is within a range of 46 to 57% of the yoke line length.

Figure 10:
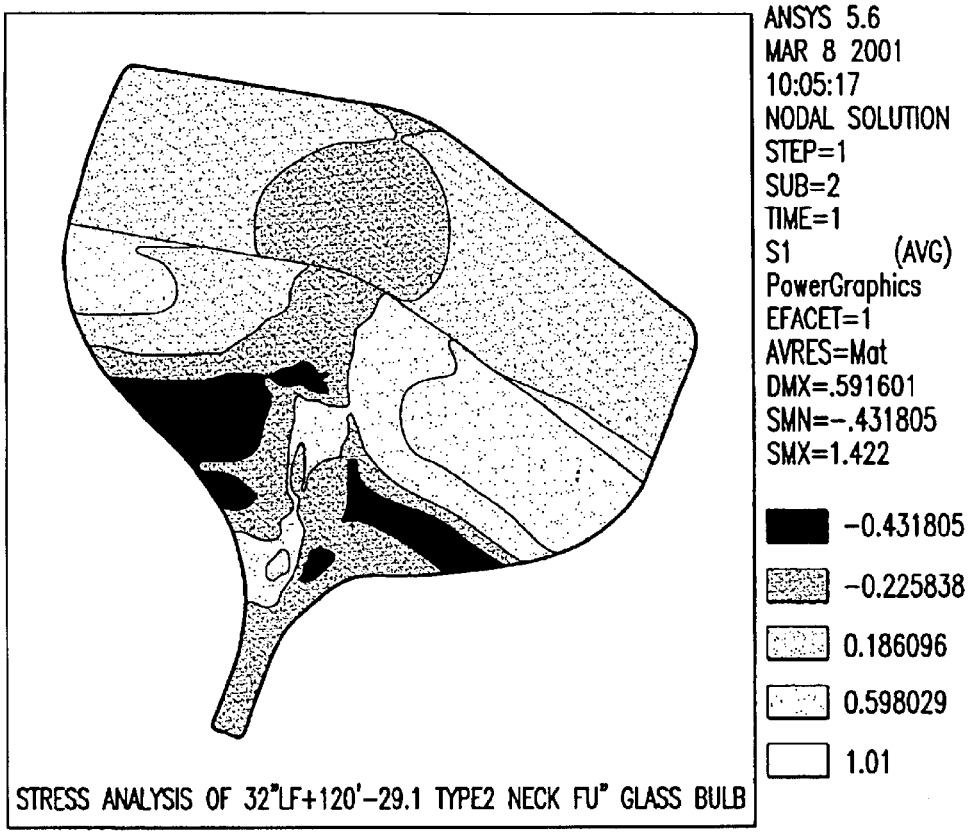
FIG. 10 is a view illustrating a simulated stress distribution in the funnel shape according to the present invention.

FIG. 10 illustrates a simulated stress distribution in the funnel shape according to the present invention. In FIG. 10, compressive stress is indicated by darker or denser shading, whereas tensile stress is indicated by the lighter or slightly shaded areas.

Referring to FIG. 10, it can be seen that the high stress generated at the seal line in a vacuum state is shifted to the body portion positioned below the seal line.

Stress generated in cathode-ray tubes having a slim structure, to which the funnel shape of the present invention and the comparative funnel shapes of FIGS. 4*a* and 4*b* are applied, respectively, are described in the following Table 3.

TABLE 3

| Funnel Shape | Stress at Seal Line Region (MPa) | Stress at Yoke Line Region (MPa) |
|---|---|---|
| First Comparative Shape | 15.3 | 6.3 |
| Second Comparative Shape | 11.5 | 21.1 |
| Present Shape | 11.5 | 10.0 |

Referring to Table 3, it can be seen that the case of the present invention has a stress reduction effect of 25% [(15.3−11.5)/15.3=0.25], as compared to the case using the first comparative funnel shape.

It can also be seen that the case of the present invention has a stress reduction effect of 53% [(21.1−10.0)/21.1=0.53], as compared to the case using the second comparative funnel shape.

Figure 1A:
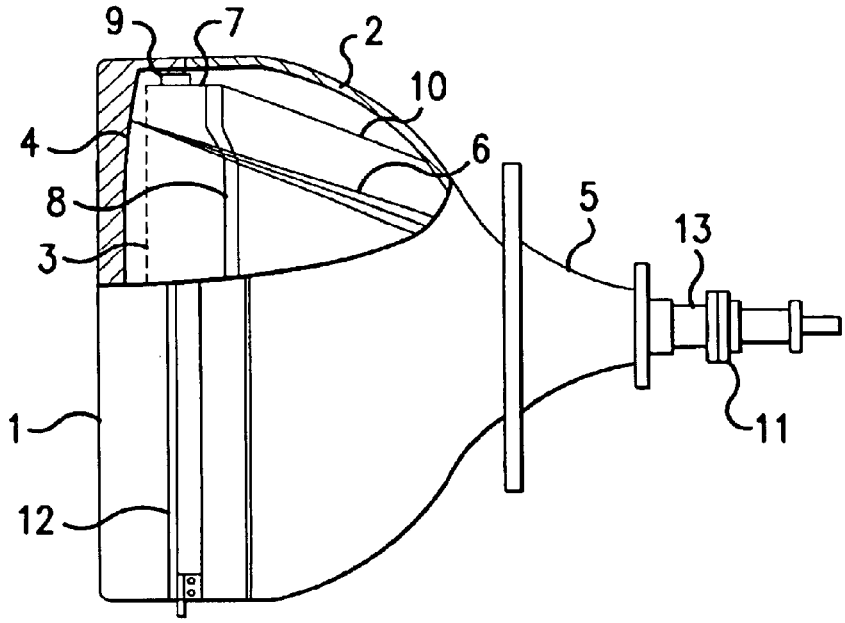
FIG.1a BACKGROUND ART
FIG. 1*a* is a partially-broken side view illustrating the structure of a general color cathode-ray tube.
Figure 2:
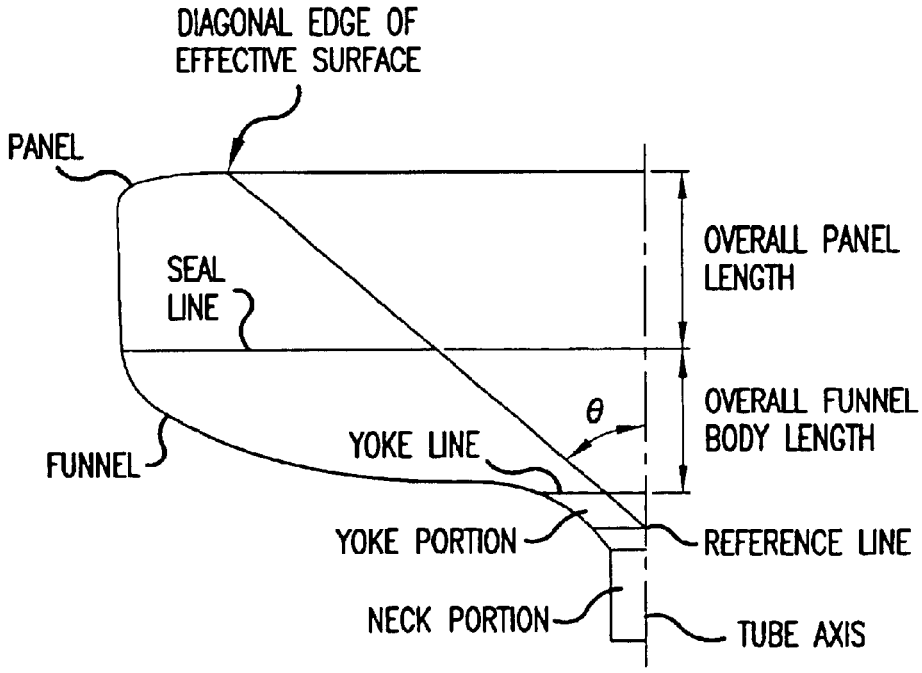
FIG. 2 is a schematic view defining essential parts of a panel and funnel glass and defining parameters associated with the present invention.

The cathode-ray tube applied to the above test has a structure in which the angle θ in FIG. 2 is 50 to 70°. As shown in FIG. 2, the angle θ is formed between a line connecting a diagonal edge of the effective surface and an intersection point between the axis of the tube and a reference line, and the axis of the tube. However, the funnel of the present invention can be applied to cathode-ray tubes having structures different from that of the above described cathode-ray tube.

As apparent from the above description, the present invention provides an effect of reducing the high stress conventionally generated around the seal line and yoke line by adjusting the length of the seal stress adjustment line and the length of the yoke stress adjustment line.

In addition, it is possible to secure desired resistance to impact, and to achieve an improvement in process yield in accordance with the reduction of the stress generated at the funnel in a vacuum state.

Although the preferred embodiments of the invention have been disclosed for illustrative purposes, those skilled in the art will appreciate that various modifications, additions and substituions are possible, without departing from the scope and spirit of the invention as disclosed in the accompanying claims.

What is claimed is:

1. A color cathode-ray tube comprising:

a panel;

a fluorescent screen provided at an inner surface of the panel;

a funnel sealably coupled to the panel;

an electron gun fitted in a neck portion of the funnel;

a deflection yoke arranged at a yoke portion of the funnel;

a shadow mask spaced apart from the fluorescent screen by a desired distance; and a frame supporting the shadow mask while applying tension to the shadow mask;

wherein a relation of $0.12 \times L' < S < 0.27 \times L'$ is satisfied where "L" represents a length from a seal line at which the panel and the funnel are sealably coupled together, to a yoke line of the funnel in an axial direction of the tube, "L'" represents ½ of the length of the seal line, "A" represents ½ of a seal stress adjustment line formed by connecting points spaced apart from the seal line by a distance of "L×0.67" toward the yoke portion, and "S" represents a difference between "L'" and "A".

2. The color cathode-ray tube according to claim 1, wherein an angle of 50° to 70° is formed between a line connecting a diagonal edge of the effective surface of the screen and an intersection point between the tube axis and a reference line in the yoke portion and the tube axis.

3. A color cathode-ray tube comprising:

a panel;

a fluorescent screen provided at an inner surface of the panel;

a funnel sealably coupled to the panel;

an electron gun fitted in a neck portion of the funnel, and adapted to generate electron beams for causing the fluorescent screen to emit light;

a deflection yoke arranged at a yoke portion of the funnel;

a shadow mask spaced apart from the fluorescent screen by a desired distance, and adapted to perform a color selecting function; and a frame supporting the shadow mask while applying tension to the shadow mask;

wherein a relation of $0.46 \times L' < Y < 0.57 \times L'$ is satisfied where "L" represents a length from a seal line at which the panel and the funnel are sealably coupled together, to a yoke line of the funnel in an axial direction of the tube, "L'" represents ½ of the length of seal line, "B" represents ½ of a yoke stress adjustment line formed by connecting points spaced apart from the seal line by a distance of "L×0.86" toward the yoke portion, and "Y" represents a difference between "L'" and "B".

4. The color cathode-ray tube according to claim 3, wherein an angle of 50° to 70° is formed between a line connecting a diagonal edge of the effective surface of the screen and an intersection point between the tube axis and a reference line in the yoke portion, and the tube axis.

* * * * *